United States Patent [19]

Grach et al.

[11] Patent Number: 4,846,045

[45] Date of Patent: Jul. 11, 1989

[54] EXPANSIBLE CHAMBER MOTOR

[75] Inventors: Ayzik Grach, Creve Coeur; Thomas M. Arens, Florissant, both of Mo.

[73] Assignee: McNeil (Ohio) Corporation, St. Paul, Minn.

[21] Appl. No.: 129,236

[22] Filed: Dec. 7, 1987

[51] Int. Cl.[4] ..... F01L 25/02

[52] U.S. Cl. ..... 91/306; 91/308; 91/313; 91/316; 91/461

[58] Field of Search ..... 91/304, 305, 306, 308, 91/313, 316, 341 R, 461

[56] References Cited

U.S. PATENT DOCUMENTS

| | | | |
|---|---|---|---|
| 1,406,330 | 2/1922 | Barner . | |
| 3,162,093 | 12/1964 | Zoller | 91/306 |
| 3,282,167 | 11/1966 | McKenzie | 91/306 |
| 3,555,966 | 1/1971 | Coniglio | 91/306 |
| 3,635,125 | 1/1972 | Rosen et al. | 91/305 X |
| 3,800,665 | 4/1974 | Von Ruden | 91/305 |
| 3,943,823 | 3/1976 | Tammy | 91/306 |
| 4,104,008 | 8/1978 | Hoffmann et al. | 417/397 |
| 4,181,066 | 1/1980 | Kitchen et al. | 91/306 |
| 4,491,055 | 1/1985 | Dollison | 91/308 X |

FOREIGN PATENT DOCUMENTS

| | | | |
|---|---|---|---|
| 528019 | 4/1954 | Belgium | 91/308 |
| 2831808 | 2/1979 | Fed. Rep. of Germany | 91/306 |

*Primary Examiner*—Edward K. Look

*Attorney, Agent, or Firm*—Senniger, Powers, Leavitt and Roedel

[57] ABSTRACT

An air-operated expansible chamber motor comprising a cylinder having first and second end heads, a piston reciprocable in the cylinder, a spool valve for controlling the supply to and exhaust of air from opposite ends of the cylinder, a relay valve mounted in one of the end heads for controlling the spool valve, a pilot valve in each end head having a stem engageable by the piston for controlling the relay valve via pressurization and exhaust of a pilot line, and a bleed for feedback of pressure air to the pilot line.

9 Claims, 3 Drawing Sheets

EXPANSIBLE CHAMBER MOTOR

BRIEF SUMMARY OF THE INVENTION

This invention relates to expansible chamber motors, and more particularly to an air-operated cylinder and piston type motor of this class.

The invention involves an air motor of the same general type as the air motors shown in U.S. Pat. Nos. 1,406,330, 3,162,093, 3,282,167, 3,555,966, 3,943,823, 4,104,008 and 4,181,066, for example.

Among the several objects of the invention may be noted the provision of an improved air-operated expansible chamber motor which is especially adapted to drive a high ratio pump for pumping high viscosity materials such as adhesives, sealants and inks, and which is useful in general for driving a pump to obtain a relatively high output at relatively high pressure of the material being pumped; the provision of such a motor which is fully pneumatically operable without any mechanical linkages subject to wear and/or breakage; the provision of such a motor which, while being fully pneumatically operable, is less subject to damage by dirty air and less subject to leakage of air; and the provision of such a motor which is relatively economical to build and maintain.

In general, a motor of this invention comprises a cylinder having first and second end heads at first and second ends thereof, a piston reciprocable in the cylinder, and valve means for controlling supply of pressure air from a source thereof to and exhaust of air from opposite ends of the cylinder. The valve means comprises a body having a bore therein and a valve member axially slidable in the bore between a first position toward one end of the bore for effecting delivery of pressure air from the source to the second end and exhaust of air from the first end of the cylinder and a second position for effecting delivery of pressure air from the source to the first end and exhaust of air from the second end of the cylinder. Means is provided biasing said valve member toward its said first position toward said one end of the bore, the bore being closed at its said one end. An air-operated relay valve controls delivery of pressure air to and exhaust of air from said one end of said bore and is controlled via a pilot line to deliver pressure air to said one end of said bore on delivery of pressure air to said pilot line and to exhaust air from said one end of the bore on exhaust of air from said pilot line. A first pilot valve controls delivery of pressure air to said pilot line, being normally closed and being opened by the piston as it approaches the first end head to deliver pressure air to the pilot line for operating the relay valve to move the valve member to its second position for effecting delivery of pressure air to the first end and exhaust of air from the second end of the cylinder to drive the piston toward the second end head of the cylinder. A second pilot valve controls exhaust of air from the pilot line, being normally closed and being opened by the piston as it approaches the second end head to exhaust the pilot line for effecting operation of the relay valve for movement of the valve member under the bias of said biasing means to its said first position to drive the piston toward the first end head of the cylinder.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
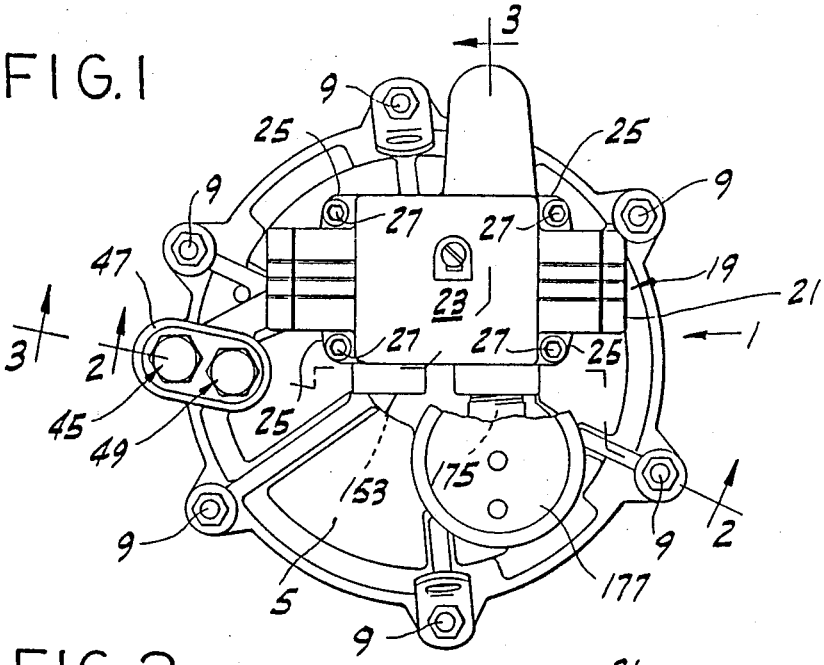
FIG. 1 is a view of the upper end of an air motor of this invention.
Figure 2:
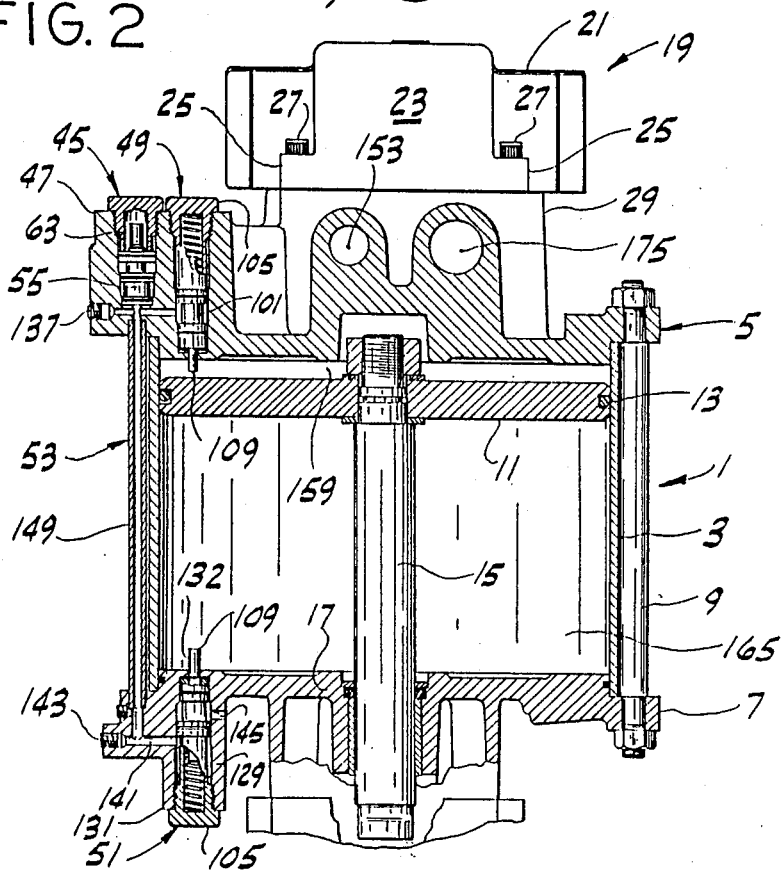
FIG. 2 is a vertical section generally on line 2—2 of FIG. 1.
Figure 3:
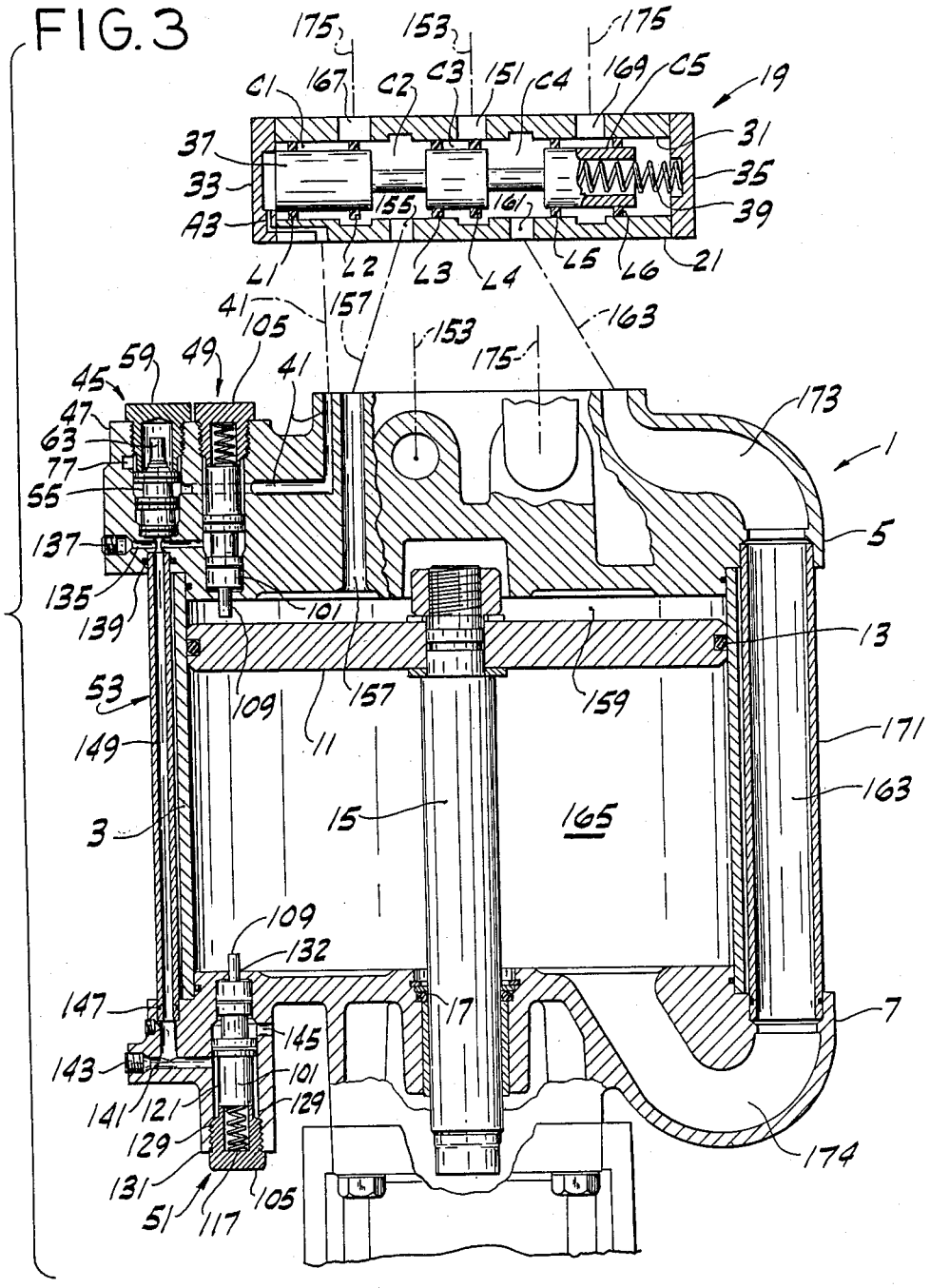
FIG. 3 is a vertical section on a larger scale than FIG. 2, the left half of this view being on the same line as FIG. 2 and the right half being on line 3—3 of FIG. 1, showing in section a directional air valve of the motor spaced from the upper end head of the motor (for facilitating illustration of air passaging)

Referring to FIGS. 1–3 of the drawings, an expansible chamber motor of this invention, designated in its entirety by the reference numeral 1, is shown to comprise a cylinder 3 which as generally used occupies a vertical position as shown in FIGS. 2 and 3 and which has first and second end heads 5 and 7 at first and second ends thereof, the first being the upper and the second being the lower end head as viewed in FIGS. 2 and 3. The cylinder preferably comprises a tube made from filament wound fiberglass with a smooth and self-lubricating inside finish. The heads are preferably cast aluminum heads, secured on the upper and lower ends of the cylinder by bolts or tie rods 9 in generally conventional manner. A motor piston 11 is reciprocable up and down in the cylinder, having an O-ring seal as indicated at 13. A piston rod 15 extends down from the piston through the lower end head 7, an O-ring seal for the rod being indicated at 17. The piston rod is adapted for connection as its lower end to a pump plunger in generally conventional manner.

Valve means generally designated 19 for controlling supply of pressure air from a source thereof to and exhaust of air from opposite ends of the cylinder is mounted on the upper end head 5. This valve means, which may be referred to as the air directional valve means, comprises a valve body 21 constituted by an elongate metal block (e.g. a cast aluminum block) generally of rectangular cross section with an enlarged central portion 23 and having integral lugs such as indicated at 25 at the bottom of the corners of the central portion receiving screws 27 for securing it on an upwardly extending portion 29 of the upper end head. The valve body 21 has a cylindric bore 31 (see FIG. 3) extending from one end thereof to the other, and end heads 33 and 35 closing the ends of the bore. A valve member 37, more particularly a valve spool, is axially slidable in the bore between a first position, which is the position in which it is indicated in FIG. 3, toward one end of the bore (its left end as illustrated) for effecting delivery of pressure air from the source to the lower (second) end of the cylinder 3 and exhaust of air from the upper (first) end of the cylinder for driving the piston 11 up, and a second position toward the other end of the bore (its right end) for effecting delivery of pressure air from the source to the upper (first) end and exhaust of air from the lower (second) end of the cylinder for driving the piston down. The spool 37 is biased by spring means 39, more particularly a coil compression spring, acting from the right-hand end head 35 against the right-hand end of the spool valve toward its stated first (left-hand) position, which is determined by engagement of its left-hand end with the left-hand end head 33 as shown in FIG. 3. The spool is movable against the bias of spring 39 to its stated second (right-hand) position, which is determined by engagement of its right-hand end with the right-hand end head 35, on delivery of pressure air to the left end of valve means 19 through a passage 41 in the upper end head and a port 43 of the valve means 19, being returned to its first position by the spring on exhaust of air from the left end of valve means 19 via port 43 and passage 41. The body 21 of the air directional valve means 19 is arranged on the upper end head 5 with the axis of the bore 31 perpendicular to the axis of the cylinder 3 so that, with the cylinder 3 vertical, the valve axis is horizontal.

The supply of air to and exhaust of air from the left end of the directional valve means 19 via 41 and 43 is under control of an air-operated relay valve 45 in another upwardly extending portion 47 of the upper end head 5, this relay valve being controlled by a first (upper) pilot valve 49 and a second (lower) pilot valve 51 via a pilot line 53. As shown in detail in FIG. 4, the relay valve comprises a tubular valve body 55 inserted in a cylindrical recess 57 extending down from the top of portion 47 of head 5 and retained in the recess by a plug 59 or threaded down in the recess. Seals for sealing the body in the recess are indicated at 61. A valve stem 63 carrying an upper elastomeric valve member 65 and a lower elastomeric valve member 67 is vertically slidable in the valve body between a lowered position wherein the upper valve member seals downwardly against an upper seat 69 in the body and the lower valve member is out of sealing engagement with respect to a lower seat 71 in the valve body, and a raised position wherein the upper valve member 65 is open with respect to seat 69 and the lower valve member is in sealing engagement with the seat 71. The stem 63 has a piston 73 at its lower end slidable in the lower end of the body 55 with a seal as indicated at 75 between piston 73 and the body 55. The piston is exposed at its bottom to air in the pilot line 53. The upper end of the stem 63 and the upper valve member 65 are exposed to air under pressure in the space in plug 59, supplied thereto via a passage 77 in the upper end head 5, an annular recess 79 around a reduced-diameter lower end 81 of the plug and ports 83 in said end of the plug. This pressure air acts on the upper end of the stem and the upper valve member 65 to bias the stem downwardly to its lowered position wherein the upper valve member 65 seals against the upper seat 69 and the lower valve member 67 is open with respect to the lower seat 71. Thus, the stem occupies its lowered position when the pilot line 53 is vented to atmosphere, and is forced up to its raised position on delivery of pressure air to the pilot line by reason of differential air pressure on the bottom of piston 73 and on the upper end of the stem 63 and the upper valve member 65, the piston being of larger diameter than member 65.

The passage 41, which is in communication via port 43 with the left-hand end of the directional air valve means 19, is in communication with an annular recess 85 around the relay valve body 55, which is in turn in communication via ports 87 in the body with an annular passage 89 around the portion of the stem between the two elastomeric valve members 65 and 67. Below the lower valve seat 71, the body 55 has another annular recess 91 which is in communication via ports 93 in the body with an annular passage 95 around the lower elastomeric valve member 67 and thence in communication with the atmosphere via a passage 97 in the upper end head. The arrangement is such that when the stem 63 is in its lowered position (i.e. when the pilot line 53 is open to exhaust) passage 41 is opened to exhaust via annular recess 85, ports 87, passage 89, passage 95, ports 93, annular recess 91 and passage 97. When the stem is in its raised position (i.e. when the pilot line 53 is pressurized) passage 41 is supplied with air under pressure from the space above the upper valve seat 69, through the opening in this valve seat, passage 89, ports 87 and the annular recess 85. Valve member 67 blocks escape of pressure air downward to the exhaust passage 97.

The stem 63 of the relay valve 45 is provided with a restricted passage or orifice 99 for bleeding air therethrough from passage 89 down to the pilot line 53. This passage or orifice 99 may be referred to as the "feedback".

Figure 5:
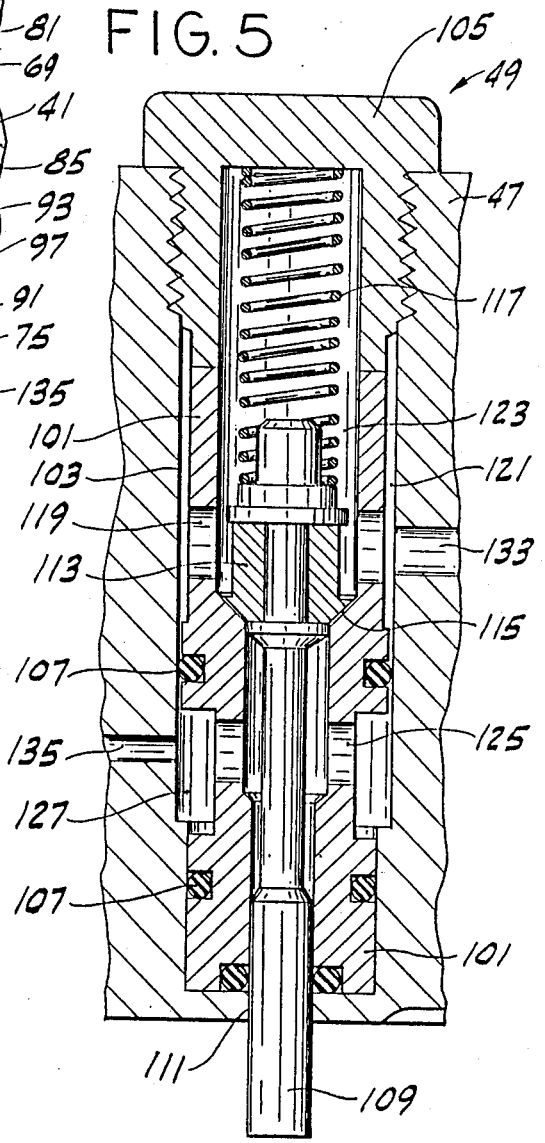
FIG. 5 is an enlarged section of a pilot valve for controlling the relay valve.

The first pilot valve 49 is a poppet valve comprising a tubular valve body 101 inserted in a cylindric recess 103 extending down from the top of portion 47 of head 5 alongside the recess 57 for the relay valve body 55 and retained in the recess by a plug 105 threaded down in the recess. Seals for sealing the body in the recess are indicated at 107. A valve stem 109 extending down through the body and out of the lower end of the body and extending down through a hole 111 in the head 5 at the lower end of the recess 103 carries an elastomeric valve member 113 engageable with a seat 115 in the body. The stem is biased downwardly toward a closed position wherein member 113 seals against the seat 115 by a spring 117 acting downwardly from the upper end of the plug 105. With the stem 109 down in its closed position, its lower end extends down into the cylinder 3 below the lower surface of the upper end head 5 for engagement by the piston 9 as it approaches the upper end head (i.e. as the piston approaches the upper end of its stroke) for lifting the stem to open member 113 off its seat. When the piston moves down, the stem is released for return by the spring 117 to its closed position of FIG. 5. The valve body 101 has radial ports as indicated at 119 above the valve seat 115 which provide for communication between a space 121 around the body and space 123 in the body, and radial ports as indicated at 125 below the seat 115 which provide for communication between the interior of the body and an annular recess 127 around the body.

The second pilot valve 51 is a poppet valve of the same construction as the first pilot valve 49, its parts being designated by the same reference numerals as the parts of the first. It is mounted in the lower end head 7 in opposed relation with respect to the first pilot valve, having its tubular valve body 101 inserted in a cylindric recess 129 extending up from the lower end of a boss 131 on the lower end head and retained in the recess 129 by plug 105 threaded up in the recess. The valve stem 109 of the lower pilot valve extends up through the valve body 101 and out of the upper end of the body, extending up through a hole 132 in the head 7 at the upper end of the recess 129. The stem of the lower pilot valve is biased upwardly by its spring 117 toward a closed position wherein its elastomeric valve member 113 seals up against its seat 115. With the stem 109 up in its closed position, its upper end extends up into the cylinder 3 above the upper surface of the lower end head 7 for engagement by the piston 9 as it approaches the lower end head (i.e. as it approaches the lower end of its stroke) for driving the stem down to open member 113 of the lower pilot valve off its seat. When the piston moves up, the stem is released for upward return by the associated spring 117 to its closed position.

The space 123 in the upper pilot valve 49 is constantly supplied with air under pressure from the source via a pressure air passage 133 in the upper end head 5 in communication with the space 121 around the body of the upper pilot valve. When the stem 109 of the upper pilot valve is driven up to its raised position wherein the upper pilot valve member 113 is off its seat 115, pressure air is supplied to the annular recess 127 around the body and thence to a passage 135 drilled in the upper end head 5 to the recess 127 and plugged as indicated at 137 at its outer end. This passage intersects a passage 139 which extends up from the bottom of the upper end head 5 outside cylinder 3. A passage 141 is drilled in the lower end head 7 to the space 121 in the lower pilot valve 51 which is below the valve seat 115 of the lower pilot valve. The outer end of this passage is plugged as indicated at 143. A vent or exhaust passage 145 is drilled in the lower end head to the recess 127 of the lower pilot valve for communication thereof with the atmosphere. Passage 141 intersects a passage 147 drilled down in the lower end head 7 outside the cylinder 3. Passage 147 is aligned with passage 139 in assembling the end heads with the cylinder. A pilot tube 149 which in conjunction with passages 135, 139, 147 and 141 constitutes the pilot line 53 has its upper end extending up into and sealed in the passage 139 and its lower end extending down into and sealed in the passage 147.

As shown in FIG. 3, the body 21 of the air directional valve means 19 has an inlet port 151 receiving pressure air from the source via passaging 153 in the upper end head, a first transfer port 155 which is in communication via a passage 157 in the upper end head 5 with the upper chamber 159 in cylinder 3 above the piston 11, a second transfer port 161 which is in communication via a passage 163 with the lower chamber 165 in the cylinder 3 below the piston, and first and second exhaust ports 167 and 169 in the upper end head. The passage 163 includes a tube or pipe 171 extending on the outside of the cylinder 3 between passages 173 and 174 in the upper and lower end heads. Air exhausts to atmosphere from the exhaust ports 167 and 169 via exhaust passaging 175 in the upper end head 5 and a muffler 177. The spool 37 of the air directional valve means 19 is constructed to provide five annular recess as indicated at C1–C5 in FIG. 3 along the bore 31, having six lands as indicated at L1–L6, with the arrangement such that when the spool is in its stated first (FIG. 3) position the air inlet port 151 is in communication via the recess C4 with the port 161 and the passage 163 to deliver pressure air to the lower end of the cylinder 3, and the passage 157 and transfer port 155 are in communication via the recess C2 with the exhaust port 167 and passaging 175 for exhausting air from the upper end of the cylinder, for upward movement of the piston. Exhaust port 169 is blocked. When the spool 37 is in its stated second position, the air inlet port 151 is in communication via the recess C2 with the port 155 and air passage 157 to deliver pressure air to the upper end of the cylinder 3, and the transfer port 161 is in communication via the recess C4 with the exhaust port 169 for exhausting air via passage 163 from the lower end of the cylinder for downward movement of the piston. Exhaust port 167 is blocked.

Figure 4:
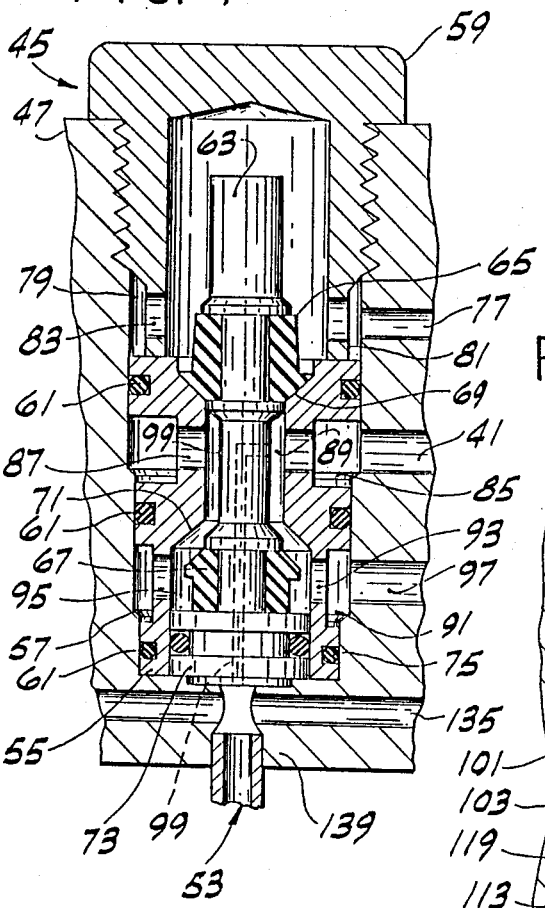
FIG. 4 is an enlarged section of a relay valve for controlling the directional valve.

In FIGS. 2–4 of the drawings, the relay valve 45 is shown with its stem 63 in its lowered position, in consequence of exhaust of air from the pilot line 53. With the valve stem 63 down, the left end of the air directional valve means 19 is vented via line 41 and the relay valve, and the spool 37 of the valve means 19 is in its stated first (FIG. 3) position for delivery of pressure air via passage 163 below piston 11 and exhaust of air via passage 157 from above the piston, for an upstroke of the piston. The piston is shown in FIGS. 2 and 3 in the position wherein, in moving upwardly toward the upper end head 5, it is about to engage the lower end of the stem 109 of upper pilot valve 49.

As the piston 11 approaches the upper end head 5, it engages the lower end of the stem 109 of the upper pilot valve 49 and drives it upwardly to its raised position. Pressure air is thereupon delivered through the upper pilot valve and via passage 135 to the pilot line 53. This results in the stem 63 of the relay valve being driven up to its raised position (and held therein by air under pressure in the pilot line). With its stem 63 in its raised position, the relay valve 45 delivers air under pressure via line 41 to the left end of the air directional valve spool 37 to shift the valve spool 37 to its stated second position (its right-hand position) wherein it effects delivery of pressure air via passage 157 above piston 11 and exhaust of air via passage 163 from below the piston, for a downstroke of the piston.

The stem 63 of the relay valve is maintained in its raised position for the downstroke of the piston throughout the downstroke by air pressure in the pilot line 53. As the piston approaches the lower end head, it engages the upper end of the stem 109 of the lower pilot valve 51 and drives it down to its lowered position. This opens the pilot line to exhaust resulting in resetting of the stem 163 of the relay valve to its lowered position for the next upstroke of the piston.

If there should be any leakage of air from the pilot line 53, as by failure of seals for the pilot line or interference by small particles with closure of the lower pilot valve 51, the feedback 99 functions to replace the lost air and thereby maintain the stem 63 of the relay valve raised for effecting a complete downstroke of the piston 11.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An air-operated expansible chamber motor comprising:

a cylinder having first and second end heads at first and second ends thereof;

a piston reciprocable in the cylinder;

valve means for controlling supply of pressure air from a source thereof to and exhaust of air from opposite ends of the cylinder comprising:

a valve body having a bore therein and a valve member axially slidable in the bore between a first position toward one end of the bore for effecting delivery of pressure air from the source to the second end and exhaust of air from the first end of the cylinder and a second position for effecting delivery of pressure air from the source to the first end and exhaust of air from the second end of the cylinder;

spring means biasing said valve member toward its said first position toward said one end of the bore;

the bore being closed at its said one end;

an air-operated relay valve for controlling delivery of pressure air from said source to and exhaust of air from said one end of said bore and controlled via a pilot line to deliver pressure air from said source to said one end of said bore on delivery of pressure air from said source to said pilot line and to exhaust air from said one end of the bore on exhaust of air from said pilot line;

a first pilot valve for controlling delivery of pressure air from said source to said pilot line, said first pilot valve being normally closed and being opened by the piston as it approaches the first end head to deliver pressure air from said source to the pilot line for operating the relay valve to move the valve member against the bias of said spring means to its second position for effecting delivery of pressure air from said source to the first end and exhaust of air from the second end of the cylinder to drive the piston toward the second end head of the cylinder; and a second pilot valve for controlling exhaust of air from the pilot line, said second pilot valve being normally closed and being opened by the piston as it approaches the second end head to exhaust the pilot line for effecting operation of the relay valve for movement of the valve member under the bias of said spring means to its said first position to drive the piston toward the first end head of the cylinder;

said spring means acting to drive said valve means to its said first position on cut-off of pressure air.

2. A motor as set forth in claim 1 wherein the first pilot valve is mounted in the first end head and the second pilot valve is mounted in the second end head.

3. A motor as set forth in claim 2 wherein the relay valve and the first pilot valve are mounted in the first end head and the pilot line extends alongside the cylinder between the end heads.

4. A motor as set forth in claim 2 having a piston rod extending from the piston through the second end head, the valve body being on the first end head.

5. A motor as set forth in claim 4 wherein the valve body is arranged with the axis of the bore in a plane generally perpendicular to the axis of the cylinder.

6. An air-operated expansible chamber motor comprising:

a cylinder having first and second end heads at first and second ends thereof;

a piston reciprocable in the cylinder;

valve means for controlling supply of pressure air from a source thereof to and exhaust of air from opposite ends of the cylinder comprising:

a valve body having a bore therein and a valve member axially slidable in the bore between a first position toward one end of the bore for effecting delivery of pressure air from the source to the second end and exhaust of air from the first end of the cylinder and a second position for effecting delivery of pressure air from the source to the first end and exhaust of air from the second end of the cylinder;

means biasing said valve member toward its said first position toward said one end of the bore;

the bore being closed at its said one end;

an air-operated relay valve for controlling delivery of pressure air to and exhaust of air from said one end of said bore and controlled via a pilot line to deliver pressure air to said one end of said bore on delivery of pressure air to said pilot line and to exhaust air from said one end of the bore on exhaust of air from said pilot line;

a first pilot valve for controlling delivery of pressure air to said pilot line, said first pilot valve being normally closed and being opened by the piston as it approaches the first end head to deliver pressure air to the pilot line for operating the relay valve to move the valve member to its second position for effecting delivery of pressure air to the first end and exhaust of air from the second end of the cylinder to drive the piston toward the second end head of the cylinder;

a second pilot valve for controlling exhaust of air from the pilot line, said second pilot valve being normally closed and being opened by the piston as it approaches the second end head to exhaust the pilot line for effecting operation of the relay valve for movement of the valve member under the bias of said biasing means to its said first position to drive the piston toward the first end head of the cylinder; and a bleed for bleeding pressure air into the pilot line.

7. A motor as specified in claim 6 wherein the bleed is in the relay valve.

8. An air-operated expansible chamber motor comprising:

a cylinder having first and second end heads at first and second ends thereof;

a piston reciprocable in the cylinder;

valve means for controlling supply of pressure air from a source thereof to and exhaust of air from opposite ends of the cylinder comprising:

a valve body having a bore therein and a valve member axially slidable in the bore between a first position toward one end of the bore for effecting delivery of pressure air from the source to the second end and exhaust of air from the first end of the cylinder and a second position for effecting delivery of pressure air from the source to the first end and exhaust of air from the second end of the cylinder;

means biasing said valve member toward its said first position toward said one end of the bore;

the bore being closed at its said one end;

an air-operated relay valve for controlling delivery of pressure air to and exhaust of air from said one end of said bore and controlled via a pilot line to deliver pressure air to said one end of said bore on delivery of pressure air to said pilot line and to exhaust air from said one end of the bore on exhaust of air from said pilot line;

a first pilot valve for controlling delivery of pressure air to said pilot line, said first pilot valve being normally closed and being opened by the piston as it approaches the first end head to deliver pressure air to the pilot line for operating the relay valve to move the valve member to its second position for effecting delivery of pressure air to the first end and exhaust of air from the second end of the cylinder to drive the piston toward the second end head of the cylinder;

a second pilot valve for controlling exhaust of air from the pilot line, said second pilot valve being normally closed and being opened by the piston as it approaches the second end head to exhaust the pilot line for effecting operation of the relay valve for movement of the valve member under the bias of said biasing means to its said first position to drive the piston toward the first end head of the cylinder;

the first pilot valve being mounted in the first end head and the second pilot valve being mounted in the second end head;

a piston rod extending from the piston through the second end head, the valve body being on the first end head;

the valve body being arranged with the axis of the bore in a plane generally perpendicular to the axis of the cylinder, and the valve member being a valve spool and the means biasing said spool being a spring means; and a bleed for bleeding pressure air into the pilot line.

9. A motor as set forth in claim 8 wherein the bleed is in the relay valve.

* * * * *